US006572730B1

(12) United States Patent
Shah

(10) Patent No.: US 6,572,730 B1
(45) Date of Patent: Jun. 3, 2003

(54) SYSTEM AND METHOD FOR CHEMICAL MECHANICAL PLANARIZATION

(75) Inventor: Nitin Shah, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/541,367

(22) Filed: Mar. 31, 2000

(51) Int. Cl.[7] ..... B24B 5/00

(52) U.S. Cl. ..... 156/345.12; 156/345.22

(58) Field of Search ..... 156/345.12, 345.22; 451/72

(56) References Cited

U.S. PATENT DOCUMENTS 5,653,623 A * 8/1997 Kimura et al. ..... 451/72
5,738,574 A 4/1998 Tolles et al. ..... 451/288
5,804,507 A 9/1998 Perlov et al. ..... 438/692
6,155,275 A * 12/2000 Shinbara ..... 134/61

OTHER PUBLICATIONS

U.S. Patent Ser. No. 09/341,771 dated Oct. 6, 1999.

U.S. Application No. 60/139,222.

U.S. Application No. 60/169,770.

* cited by examiner

*Primary Examiner*—Benjamin L. Utech
*Assistant Examiner*—Sylvia R. MacArthur
(74) *Attorney, Agent, or Firm*—Moser, Patterson & Sheridan

(57) ABSTRACT

A semiconductor wafer processing system for polishing a substrate that generally includes a base having a first side and a second side, and at least one drive system that is disposed on the first side of the base. One or more polishing heads are coupled to the drive system for retaining a workpiece during polishing. A first enclosure is disposed on the first side of the base and defines a first volume that includes the drive system. A second enclosure is disposed on the second side of the base and defines a second volume. A first exhaust is coupled to the second volume. When the system is coupled to a facilities exhaust or other air handler, the first exhaust ventilates the second volume. In another aspect, a method for processing a substrate is also disclosed. Generally, the method includes the steps of monitoring the flow metrics of a first exhaust from a first enclosure and a second exhaust from a second enclosure. If the flow metrics fall outside a predetermined processing window, a step of polishing the substrate is stopped.

19 Claims, 3 Drawing Sheets

SYSTEM AND METHOD FOR CHEMICAL MECHANICAL PLANARIZATION

BACKGROUND OF THE DISCLOSURE

1. Field of Invention

The present invention relates generally to a semiconductor wafer processing system and a method for polishing a substrate.

2. Background of Invention

In semiconductor wafer processing, the use of chemical mechanical planarization, or CMP, has gained favor due to the enhanced ability to stack multiple devices on a semiconductor workpiece, or substrate, such as a wafer. As the demand for planarization of layers formed on wafers in semiconductor fabrication increases, the requirement for greater system (i.e., process tool) throughput with less wafer damage and enhanced wafer planarization has also increased.

Two exemplary CMP systems that address these issues are described in U.S. Pat. No. 5,804,507, issued Sep. 8, 1998 to Perlov et al. and in U.S. Pat. No. 5,738,574, issued Apr. 15, 1998 to Tolles et al., both of which are hereby incorporated by reference. Perlov et al. and Tolles et al. disclose a CMP system having a planarization system that is supplied wafers from cassettes located in an adjacent liquid filled bath. A transfer mechanism, or robot, facilitates the transfer of the wafers from the bath to a transfer station. The transfer station generally contains a load cup that positions the wafer into one of four processing heads mounted to a carousel. The carousel moves each processing head sequentially over the load cup to receive a wafer. As the processing heads fill, the carousel moves the processing head and wafer through the planarization stations for polishing. The wafers are planarized by moving the wafer relative to a polishing pad in the presence of a slurry or other polishing fluid medium. The polishing pad may include an abrasive surface. Additionally, the slurry typically contains both chemicals and abrasives that aid in the removal of material from the wafer. After completion of the planarization process, the wafer is returned back through the transfer station to the proper cassette located in the bath.

Generally, the polishing system is surrounded by an upper enclosure. The upper enclosure isolates the system environment from the surrounding ambient environment and is typically supplied with filtered air, thus minimizing possible substrate contamination. As such, the upper enclosure over the processing area typically contains an exhaust in the ceiling of the enclosure to provide an air return and to vent any gases that may have out-gassed during the polishing process.

Additionally, the lower portion of the system is also enclosed to capture and remove any slurry or other fluids may find their way into the lower portion of the system due to spillage, pad run off or leaks. Slurry and other fluids in the lower portion of the polishing system are generally collected and channeled from the system to a central facility drainage system. However, these slurries or other fluids or their residues may out-gas into the volume defined by the lower portion of the system. Movement of these gases into the upper enclosure from which they may be vented is often slow.

Therefore, there is a need in the art for a system that provides ventilation of the lower portions of a chemical mechanical polishing system.

SUMMARY OF INVENTION

Generally, the present invention provides a system and method for exhausting a lower region of a chemical mechanical processing system. In one embodiment, the invention provides a base having a first or working side and a second side, and at least one drive system that is disposed on the working side of the base. One or more polishing heads are coupled to the drive system for retaining a workpiece during polishing. A second side enclosure is disposed on the second side of the base and defines a second side volume. A second side exhaust is coupled to the second side volume. When the invention is coupled to a facilities exhaust or other air handler, the second side exhaust ventilates the second side volume.

In another embodiment, the system additionally includes a working side enclosure that is disposed on the working side of the base and defines a working side volume that includes the drive system. A working side exhaust is coupled to the working side volume and can be adapted to ventilate the working side volume.

In another aspect, a method for processing a workpiece is also disclosed. In one embodiment, the method comprises the steps of exhausting a first enclosure through a first exhaust; obtaining a first flow metric indicative of the flow through the first exhaust; exhausting a second enclosure through a second exhaust; obtaining a second flow metric indicative of the flow through the second exhaust; polishing the substrate; monitoring the first and second flow metrics to determine if they fall within a predetermined processing window; and stopping the polishing step if the first flow metric, the second flow metric or the first and second flow metrics fall outside of the window.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
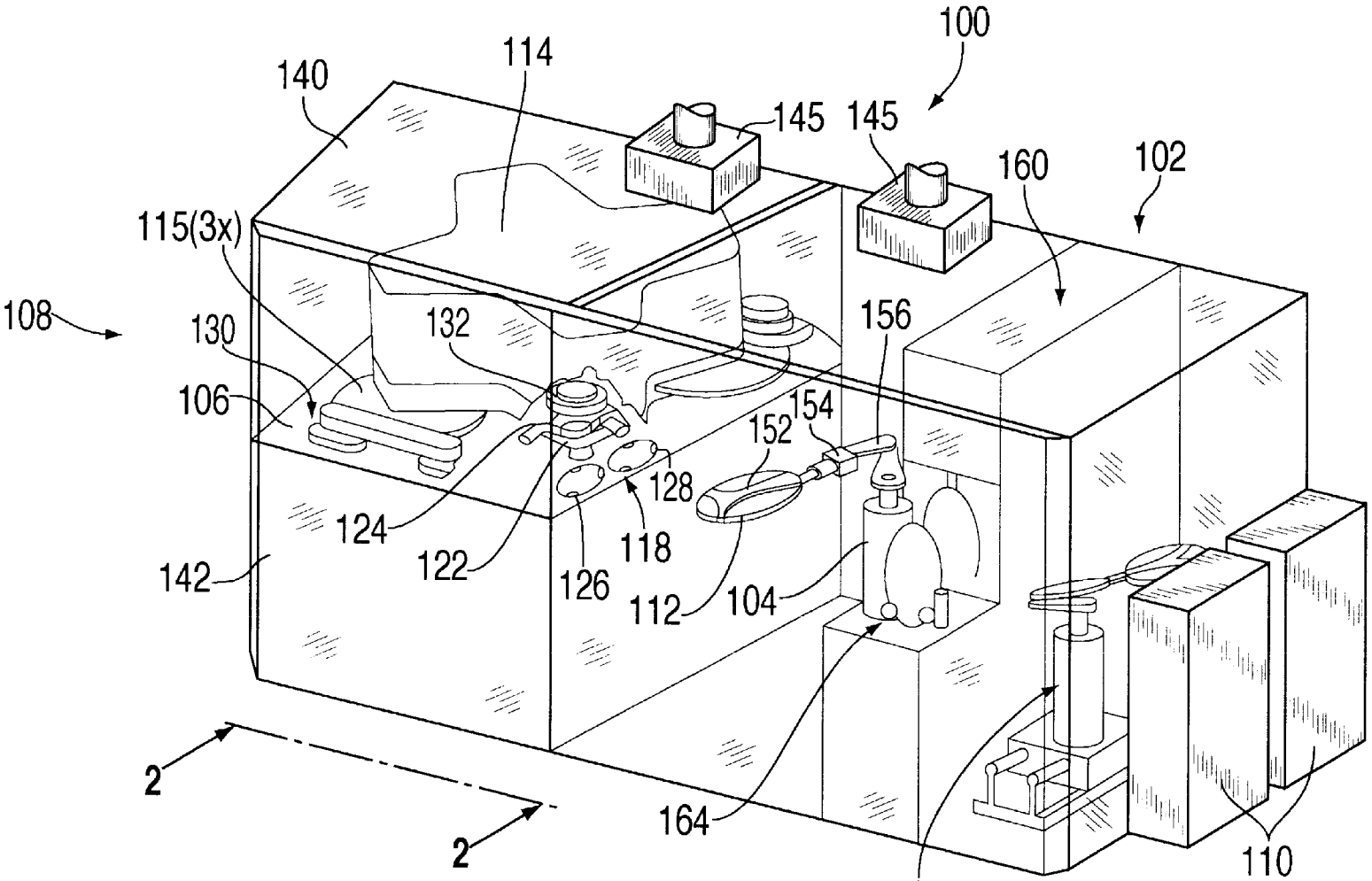
FIG. 1 is a perspective view of a chemical mechanical planarization system of the invention.

FIG. 1 depicts a perspective view of a chemical mechanical planarization system 100. The exemplary system 100 generally comprises a factory interface 102, a loading robot 104, and a polishing module 108. Generally, the loading robot 104 is disposed proximate the factory interface 102 and the polishing module 108 to facilitate the transfer of substrates 112 therebetween.

The factory interface 102 generally comprises a cleaning module 160 and one or more wafer cassettes 110. A interface robot 162 is employed to transfer substrates 112 between the wafer cassettes 110, the cleaning module 160 and an input module 164. The input module 164 is positioned such that unpolished substrates 112 retrieved from the cassettes 110 by the interface robot 162 may be transferred to the loading robot 104, while polished substrates 112 returning from the polishing module 108 are placed in the input module 164 by the loading robot 104. Polished substrates 112 typically are passed from the input module 164 through the cleaning module 160 before the factory interface robot 162 returns the cleaned substrates 112 to the cassettes 110. An example of such a factory interface 102 is disclosed in U.S. Provisional Patent Application serial No. 60/139,222, filed Jun. 15, 1999, which is hereby incorporated by reference in its entirety.

The loading robot 104 is generally positioned proximate the factory interface 102 and the polishing module 108 such that the range of motion provided by the robot 104 facilitates transfer of the substrates 112 therebetween. An example of a loading robot 104 is a 4-Link robot, manufactured by Kensington Laboratories, Inc., Richmond, Calif.

The exemplary loading robot 104 has an articulated arm 156 having a rotary actuator 154 at its distal end. An edge contact gripper 152 is coupled to the rotary actuator 154. The rotary actuator 154 permits the substrate 112 secured by the gripper 152 to be orientated in either a vertical or horizontal orientation without contacting the feature side 120 of the substrate 112 and possibly causing scratching or damage to the exposed features. Additionally, the edge contact gripper 152 securely holds the substrate 112 during wafer transfer thus decreasing the probability of the wafer coming disengaged. Optionally, other types of grippers, such as electrostatic grippers, vacuum grippers and mechanical clamps, may be substituted.

One polishing module 108 which can be used to advantage with the present invention is a Mirra® Chemical Mechanical Polisher manufactured by Applied Materials, Inc., located in Santa Clara, Calif. Mirra is a registered trademark of Applied Materials, Inc. Other polishing modules 102 may also be used to advantage.

The exemplary polishing module 108 has a plurality of polishing stations 115 (two of three are shown), a drive system (e.g., a carousel 114), a polishing head interface 116 and a transfer station 118 that are disposed on a first or working side 106 of a machine base 130. In one embodiment, the transfer station 118 comprises at least an input buffer station 126, an output buffer station 128, a transfer robot 122, and a load cup assembly 124. The loading robot 104 places the substrate 112 onto the input buffer station 126. The input buffer station 126 supports the substrate 112 on three pins proximate the edge of the substrate 112. The transfer robot 122 has two gripper assemblies, each having pneumatic gripper fingers that grab the substrate 112. The fingers retain the substrate 112 at three points on the edge of the substrate 112. The transfer robot 122 lifts the substrate 112 from the input buffer station 126 and rotates the gripper and substrate 112 to position the substrate 112 over the load cup assembly 124, then places the substrate 112 down onto the load cup assembly 124. An example of such a transfer station 118 is described by Tobin in U.S. patent application Ser. No. 09/314,771, filed Oct. 6, 1999, and is hereby incorporated by reference in its entirety.

The drive system or carousel 114 is generally described by Tolles in the previously incorporated U.S. Pat. No. 5,804,507. Generally, the carousel 114 includes a one or more polishing heads 132 coupled to the carousel 114. In one embodiment, the polishing head 132 is a Titan Head™ wafer carrier manufactured by Applied Materials, Inc., Santa Clara, Calif. The carousel 114 is centrally mounted to the base 130 and supports the polishing heads 132 above the polishing stations 115 and polishing head interface 116. The carousel 114 is indexable such that the polishing heads 132 may be moved between the polishing stations 115 and the polishing head interface 116. The polishing head 132 positioned at the polishing head interface 116 receives the substrate 112 from the load cup assembly 124. After loading the substrate 112, the carousel 114 indexes the just loaded substrate 112 to one of the polishing stations 115. At the polishing station 115, the substrate 112 is polished by moving the substrate 112 relative a polishing surface 134 disposed in the polishing station 115. To enhance and control the polishing process, a slurry is optionally disposed on the polishing surface 134 through one or more nozzles 136. The slurry is typically comprised of de-ionized water or other polishing medium that may additionally contain abrasive particles.

As the carousel 114 indexes, the next polishing head 132 is positioned at the polishing head interface 116 where the polished substrate 112 is offloaded from the polishing head 132 and another unpolished substrate 112 is loaded into the carousel 114. The process of rotationally polishing a substrate is described by Perlov et al., in the previously incorporated U.S. Pat. No. 5,804,507.

Once the substrate 112 has completed the polishing process, the polishing head 132 releases the substrate 112 into the load cup assembly 124, and the transfer robot 122 removes the substrate 112 from the load cup assembly 124. The polished substrate 112 is then placed in the output buffer station 128 by the transfer robot 122 where it remains until the loading robot 104 removes the polished substrate 112 from the transfer station 118.

One skilled in the art will note that other polishing modules having diverse drive systems may be incorporated into the invention. For example, a linear drive system having two or more polishing heads may be substituted for the illustrated carousel 114. An example of such a polishing system having a linear drive system is disclosed in U.S. Provisional Patent Application No. 60/169,770 by Sommer et al., (filed Dec. 9, 1999, which is hereby incorporated by reference.

The region above the machine base 130 that supports the carousel 114 is enclosed by a first or working side enclosure 140. The region below the machine base 130 is enclosed by a second or second side enclosure 142. The loading robot 104 and factory interface 102 are optionally enclosed by a third enclosure 144. Typically, the loading robot 104 is able to access the polishing module 108 via a port (260 in FIG. 2) that provides access between the first and the third enclosures 140, 144. The working side enclosure 140 and the third enclosure 144 typically are supplied with filtered air delivered to the enclosures through one or more high efficiency air filters 145 generally commercially available, for example, from Camfil-Filtra, located in Riverdale, N.J. The relative pressures between the working side enclosure 140 and the third enclosure 144 may be regulated such that the movement of gases through the port 260 may be controlled.

Figure 2:
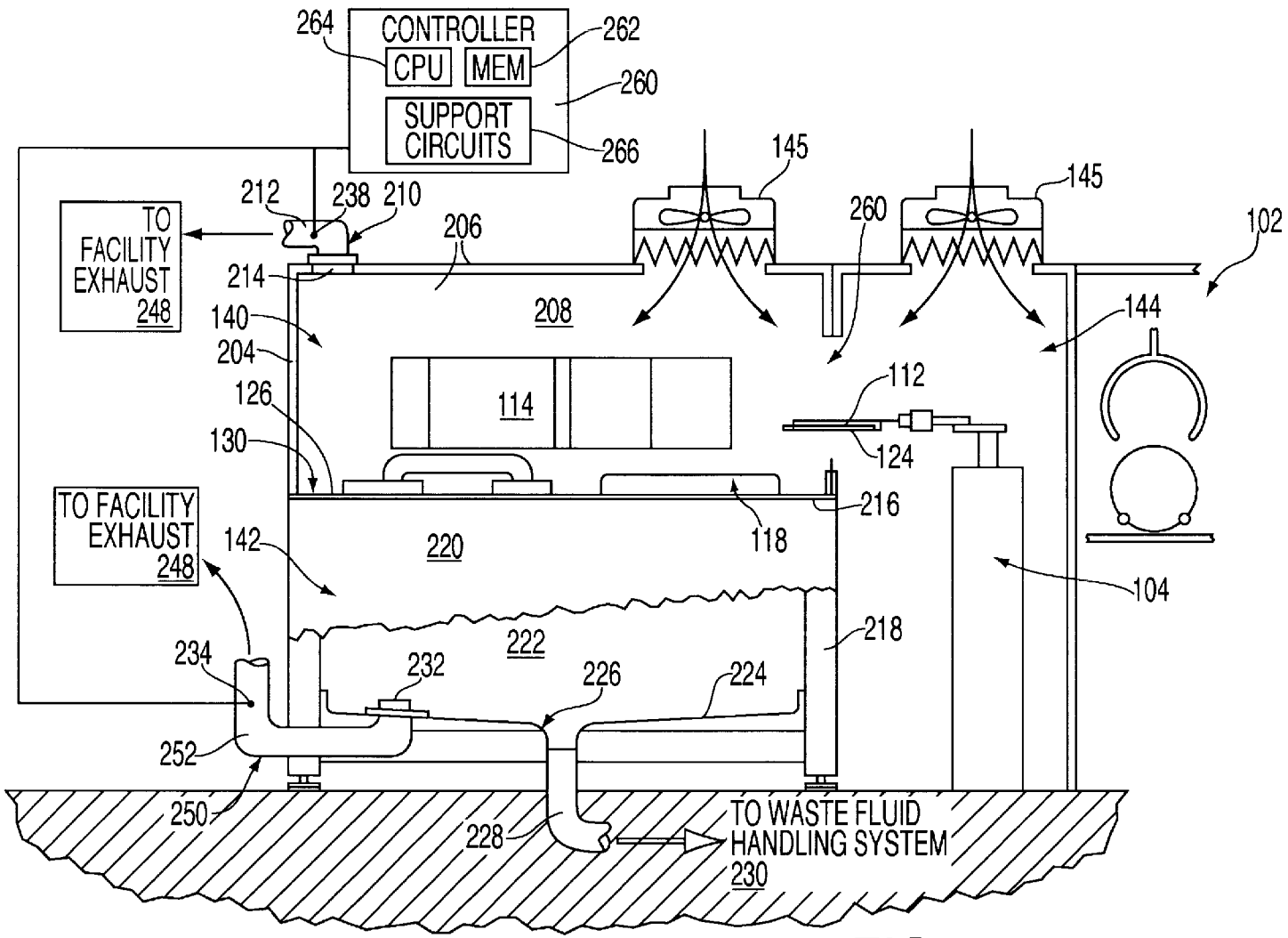
FIG. 2 is a schematic elevation of a portion of the chemical mechanical planarization system of FIG. 1.
Figure 3:
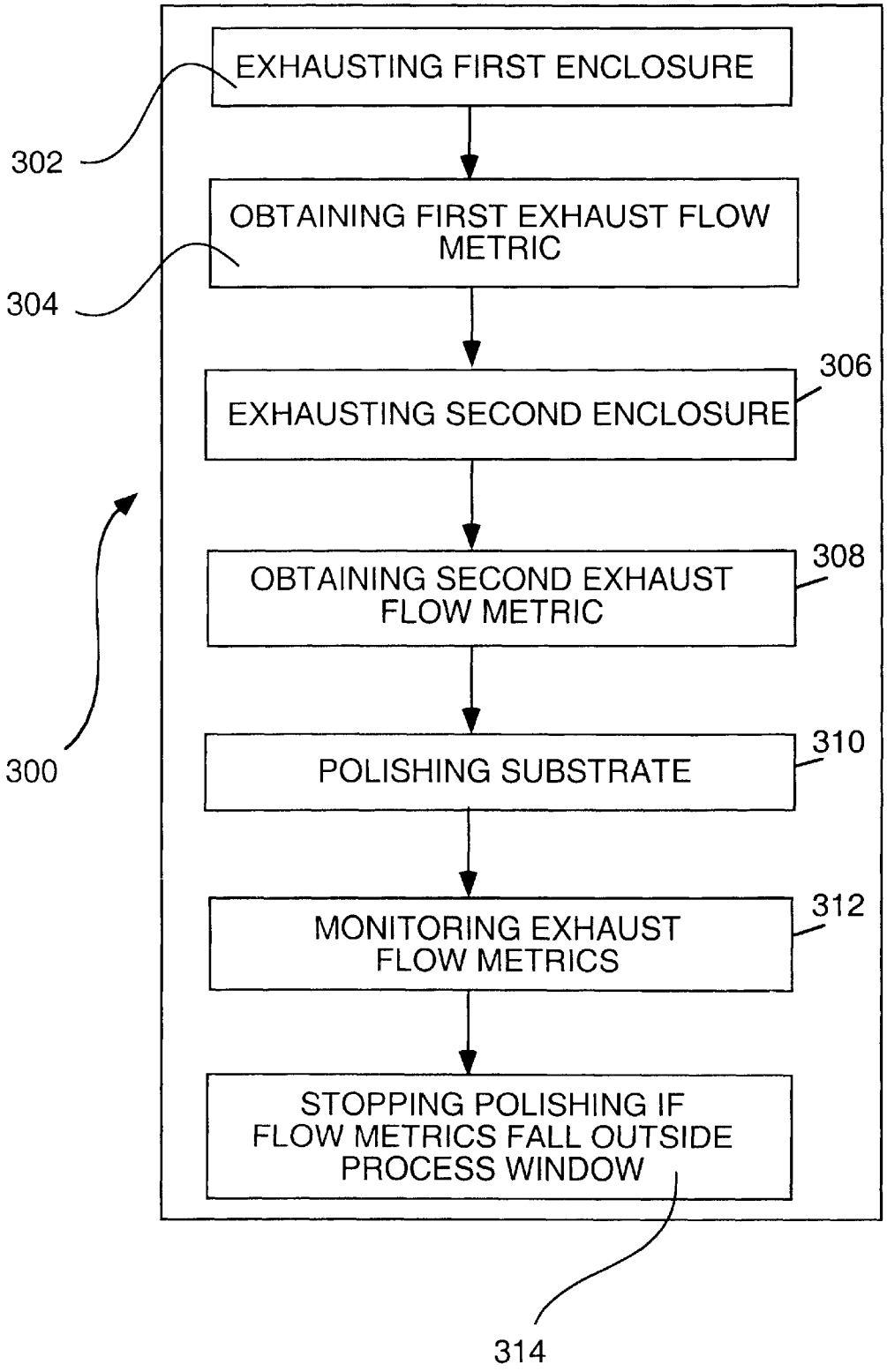
FIG. 3 is a flow diagram depicting a method for polishing a substrate.

FIG. 2 depicts a portion of the planarization system 100 in cross section including the working side enclosure 140 and second side enclosure 142. The working side enclosure 140 is generally disposed on the working side 106 of the base 130. The working side enclosure 140 typically includes a steel tube or an extruded aluminum frame 204 that supports a plurality of acrylic or other polymer sheets 206 to define a first or working side volume 208. The polymer sheets 206 are preferably clear and may be hinged or removably attached to allow access to the working side volume 208.

To ventilate the working side enclosure 140, at least a first or working side exhaust 210 that communicates with the working side volume 208 is coupled to the working side enclosure 140. The working side exhaust 210 generally comprises a duct 212 coupled to a flange 214 mounted through one of the polymer sheets 206 of the working side enclosure 140, typically the sheet 206 comprising the top of the working side enclosure 140. In one embodiment, the flange 214 has an internal diameter of at least 4 inches. The duct 212 is couples the working side enclosure 140 to the facility's central exhaust 248.

Flow rates through the working side exhaust 210 are monitored by sensing a flow metric within the working side exhaust 210 using a first sensor 238 that is in communication with the working side exhaust 210. In one embodiment, the first sensor 238 is generally an industrial a grade pressure sensor capable of measuring pressure up to about 2.5 inches of water. Other types of sensors that measure other types of flow metric such as velocity, mass or volume flow and other indicators of flow. In one embodiment, at least about 120 cubic feet per minute is exhausted from the working side volume 208 while the first sensor 238 measures at least about 0.42 inches of water.

The second side enclosure 142 is generally disposed below or to a second side 216 of the base 130. The second side enclosure 142 typically includes a steel tubing lower frame 218 that supports the base 130 and a plurality of polymer or sheet metal panels 220 disposed therebetween to define a second or second side volume 222. Generally, the second side volume 222 is bounded on the side opposite the base 130 by a catch basin 224. At least one of the sheet metal panels 220 is typically hinged or removably attached to allow access to the second side volume 222.

The catch basin 224 is typically fabricated from a corrosion resistant material such as stainless steel and is positioned below the base 130 such that any leaks or spillage of slurry or other fluids utilized by the system 100 are collected by the catch basin 224. Preferably, the catch basin 224 is configured to have a sump 226 positioned to facilitate in the collection and removal of fluids from the catch basin 224. A central fluid drain 228 couples the sump 226 to a facilities waste fluid handling system 230. Alternatively, the catch basin 224 may be coupled to a dedicated collection system that collects and stores the waste fluids for later removal.

A second or second side exhaust 250 is coupled to the second side enclosure 142 to ventilate the second side volume 222. The second side exhaust 250 generally comprises a conduit 252 coupled to a flange 232. Generally, the flange 232 is coupled to the catch basin 224 at an elevation closer to the base 130 than the sump 226. In one embodiment, the flange 232 has an inside diameter of about 4 inches that is coupled to the central exhaust system of the facility 248. Flow rates through the second side exhaust 250 are monitored by a flow metric within the second side exhaust 250 using a second sensor 234. In one embodiment, the second sensor 234 is generally an industrial grade pressure sensor capable of measuring pressure up to about 2.5 inches of water. Other types of sensors that measure other types of flow metric such as velocity, mass or volume flow and other indicators of flow. The second side exhaust 250 is also coupled to the facility's central exhaust 148.

In one embodiment, the second side volume 222 is exhausted through the flange 232 at a rate of about 120 cubic feet per minute. The static pressure at that flow is at least about 0.42 inches of water measured by the second sensor 234 disposed in the second side exhaust 250.

To facilitate control of the system 100 and to ensure that the working side exhaust 210 and the second side exhaust 250 are functioning properly, a controller 260 is coupled to the first sensor 238 and the second sensor 234. The controller 260 generally includes a central processing unit (CPU) 264, a memory 262, and support circuits 266 for the CPU 264 that are coupled to the various components of the polishing module 108 to facilitate control of the polishing process.

To facilitate control of the polishing module 108 as described above, the CPU 264 may be one of any form of computer processor that can be used in an industrial setting for controlling various modules and subprocessors. The memory 262 is coupled to the CPU 264. The memory 262, or computer-readable medium, may be one or more of readily available memory such as random access memory (RAM), read only memory (ROM), floppy disk, hard disk, or any other form of digital storage, local or remote. The support circuits 266 are coupled to the CPU 264 for supporting the processor in a conventional manner. These circuits include cache, power supplies, clock circuits, input/output circuitry and subsystems, and the like. A polishing process 300 is generally stored in the memory 262. The polishing process 300 may also be stored and/or executed by a second CPU (not shown) that is remotely located from the hardware being controlled by the CPU 264.

One embodiment of the polishing process 300 is discussed with respect to FIGS. 1, 2 and 4. Generally, the polishing routine 300 is continually executed after the system 100 is energized. Optionally, polishing routine 300 is executed periodically. The polishing routine 300, when executed by the CPU 264, transforms the computer into a specific purpose computer (controller) 140 that controls the polishing operation such that the polishing process 300 is performed. Although the process of the present invention is discussed as being implemented as a software routine, some of the method steps that are disclosed therein may be performed in hardware as well as by the software controller. As such, the invention may be implemented in software as executed upon a computer system, in hardware as an application specific integrated circuit or other type of hardware implementation, or a combination of software and hardware.

The exemplary polishing process 300 begins by exhausting the working side enclosure 140 at step 302. An indicia of flow rate through the working side exhaust 210 is obtained by the first sensor 238 that provides a flow metric to the controller 260 at step 304. In one embodiment, the first sensor 238 measures a pressure of the flow through the working side exhaust 210 as an indicator of flow. The second enclosure 144 is exhausted at step 306. An indicia of flow rate through the second side exhaust 250 is obtained by the second sensor 234 that provides a flow metric to the controller 260 at step 308. In one embodiment, the second sensor 234 measures pressure of the flow through the second side exhaust 250 as an indicator of flow. The substrate 112 disposed in the polishing module 108 is polished at step 310, and in one embodiment, the substrate is polished using a chemical mechanical planarization process that may include the use of a polishing medium such as a slurry. In step 312, the controller 260 monitors the flow metrics obtained in steps 304 and 308 to determine if one or both of the flow metrics are outside a predetermined process window. In one embodiment, the process window is set where both the first and second exhausts have a flow rate of at least about 120 cubic feet per minute. If one or both of the flow metrics are outside the process window, the process of step 310 is stopped in step 314.

Optionally, step 314 may include allowing a time T for the flow metrics to move back within the process window without stopping the process of step 310. Time T may be defined by the system user, for example, time T may be set for about 2 minutes. Additionally, step 314 may include operator warnings to be displayed during and after time T.

Referring to FIGS. 1 and 2, in operation, the working side enclosure 140 and the second side enclosure 142 is vented through the first and second exhausts 210, 250, respectively. The substrate 112 is transferred from the factory interface 102 to the polishing module 108 by the loading robot 104. The substrate 112 is loaded into one of the polishing heads 132. The carousel 114 moves the polishing head 132 and substrate to one of the polishing stations 115 wherein the polishing process is performed. Optionally, the substrate 112 may be additionally polished at other polishing stations 115. During the polishing process, the first and second exhausts 210, 250 are monitored to ensure adequate ventilation of the first and second enclosures 142, 144. Once the substrate 112 is polished, the substrate 112 is returned to the factory interface 102 by the loading robot 104.

Although the teachings of the present invention that have been shown and described in detail herein, those skilled in the art can readily devise other varied embodiments that still incorporate the teachings and do not depart from the spirit of the invention.

What is claimed is:

1. A processing system for polishing a semiconductor workpiece, comprising:

a base having a first side and a second side;

at least one drive system disposed on the second side of the base;

one or more polishing heads coupled to the drive system for retaining a workpiece during polishing;

a first enclosure disposed on the first side of the base and defining a first volume;

a first gas exhaust coupled to the first volume;

a catch basin disposed in the first volume; and a flange disposed in the catch basin, the flange coupled to the first gas exhaust, wherein the flange has an internal diameter of at least 4 inches.

2. The processing system of claim 1, wherein the first enclosure contains gases that are moved through the first gas exhaust at least about 120 cubic feet per minute.

3. The processing system of claim 2, wherein the flow of gases through the first gas exhaust has at least about 0.42 inches of static pressure.

4. The processing system of claim 1 further comprising:

a second enclosure disposed on the second side of the base and defining a second volume that includes the drive system.

5. The processing system of claim 4 further comprising:

a second gas exhaust coupled to the second volume.

6. The processing system of claim 1, wherein the catch basin further comprises:

a fluid drain disposed in the catch basin.

7. A processing system for polishing a semiconductor workpiece comprising:

a base having a first side and a second side;

at least one drive system disposed on the first side of the base;

one or more polishing heads coupled to the drive system for retaining a workpiece during polishing;

a first enclosure disposed on the first side of the base and defining a first volume that includes the at least one drive system;

a first gas exhaust coupled to the first volume;

a second enclosure disposed on the second side of the base and defining a second volume;

a catch basin disposed in the second enclosure;

a flange disposed in the catch basin; and a second gas exhaust coupled to the second volume through the flange.

8. The processing system of claim 7 further comprising:

a fluid drain disposed in second enclosure.

9. The processing system of claim 7, wherein the first gas exhaust and second gas exhaust are coupled to a central facilities gas exhaust system.

10. A processing system for polishing a semiconductor workpiece, comprising:

a base having a first side and a second side;

at least one drive system disposed on the first side of the base;

one or more polishing heads coupled to the drive system for retaining a workpiece during polishing;

a first enclosure disposed on the second side of the base and defining a first volume;

a catch basin disposed in the first volume;

a first exhaust coupled to the first volume; and a flange disposed in the catch basin, the flange coupled to the first exhaust.

11. The processing system of claim 10 further comprising:

a second enclosure disposed on the first side of the base and defining a second volume that includes the drive system.

12. The processing system of claim 11 further comprising:

a second exhaust coupled to the second volume.

13. The processing system of claim 11, wherein the catch basin further comprises:

a fluid drain disposed in the catch basin.

14. The processing system of claim 11, wherein the flange has an internal diameter of at least 4 inches.

15. The processing system of claim 11, wherein the first enclosure contains gases that are moved through the first exhaust at least about 120 cubic feet per minute.

16. The processing system of claim 15, wherein flow of gases through the first exhaust has at least about 0.42 inches of static pressure.

17. A processing system for polishing a semiconductor workpiece comprising:

an enclosure;

a base separating the enclosure into a first volume to a first side of the base and a second volume to a second side of the base;

a polishing surface disposed on the first side of the base;

a polishing head disposed in the first volume for retaining a workpiece against the polishing surface during processing;

a first gas exhaust coupled to the first volume;

a catch basin disposed in the second enclosure;

a flange disposed in the catch basin; and a second gas exhaust coupled to the second volume through the flange.

18. The processing system of claim 17 further comprising:

a gas mover coupled to the first gas exhaust adapted to move gases from the second volume through the second gas exhaust at least about 120 cubic feet per minute.

19. The processing system of claim 18, wherein flow of gases through the first gas exhaust has at least about 0.42 inches of static pressure.

* * * * *